United States Patent [19]

Barberis

[11] Patent Number: 4,785,754

[45] Date of Patent: Nov. 22, 1988

[54] DEVICE FOR AVOIDING CAPSIZING OF CATAMARANS

[76] Inventor: Michele Barberis, Via Garessio, 18, Turin, Italy

[21] Appl. No.: 66,867

[22] Filed: Jun. 25, 1987

[30] Foreign Application Priority Data

Mar. 27, 1987 [IT] Italy ..... 67234 A/87

[51] Int. Cl.[4] ..... B63B 39/00

[52] U.S. Cl. ..... 114/39.1; 114/61; 114/91; 114/122

[58] Field of Search ..... 114/39.1, 89, 90, 91, 114/92, 93, 94, 121, 122, 61

[56] References Cited

U.S. PATENT DOCUMENTS

| | | | |
|---|---|---|---|
| 559,983 | 5/1896 | McLean | 114/91 |
| 3,099,976 | 8/1963 | Schwaneke et al. | 114/91 |
| 3,610,190 | 10/1971 | Palmer | 114/91 |
| 3,903,827 | 9/1975 | Marcil | 114/91 |
| 3,985,106 | 10/1976 | Ross | 114/91 |
| 4,117,797 | 10/1978 | Kelly et al. | 114/91 |
| 4,501,215 | 2/1985 | Hart et al. | 114/91 |

FOREIGN PATENT DOCUMENTS

| | | | |
|---|---|---|---|
| 2151195 | 7/1985 | United Kingdom | 114/91 |

*Primary Examiner*—Sherman D. Basinger
*Assistant Examiner*—Stephen P. Avila
*Attorney, Agent, or Firm*—John F. A. Earley; John F. A. Earley, III

[57] ABSTRACT

A device for avoiding capsizing of catamarans, in which a mast of the catamaran is pivotally mounted on a transverse beam of connection between two hulls and kept in position by two shrouds which, starting from the top of the mast and winding around tensioning pulleys and positioning pulleys, are connected to a movable point of a piston device, which is of the oleodynamic-mechanical type and generally comprises a piston head kept in position in a cylinder by resiliency and made of two parts connected to each other by a calibrated helical spring. A pipe with a pump and unidirectional valves and for the oil of the oleodynamic device are provided outwardly of the cylinder. When the load on the mast exceeds the value of calibration of the spring, the piston head opens to uncover apertures for the passage of the oil which in this manner circulates and permits shifting of the piston head in the cylinder. The mast only bends if the wind acting on the sail exceeds the calibration value of the spring.

14 Claims, 3 Drawing Sheets

DEVICE FOR AVOIDING CAPSIZING OF CATAMARANS

BACKGROUND OF THE INVENTION

This invention relates to a device for avoiding capsizing of catamarans.

It is known that the problem of capsizing of boats has always been a pressing problem for the users thereof and that from time to time solutions have been sought to the problem.

The present invention provides a solution to the problem when the boat is a catamaran, i.e. a boat with two hulls.

It is known that catamarans have the mast of the sail secured to one of the transverse beams connecting the two hulls and that the mast is secured to the transverse beam in a fixed manner perpendicularly thereto for best utilization of the power of the wind.

However, often the wind has a greater power than expected and may change suddenly and then it is the task of the user to act rapidly and on time on the sails to reduce the useful surface thereof and contain the thrust of the wind which otherwise, with the sails unfolded, would cause the catamaran to capsize or the mast to break.

It is an object of the present invention to avoid these drawbacks by providing a safety device for avoiding capsizing of catamarans, which, in the case of a sudden storm and thus a sudden unexpected violence of the wind, will save both the mast and the boat, permitting the user to act with relative calm on the sails without running particular risks.

SUMMARY OF THE INVENTION

The fundamental characteristic of the present invention consists in that the mast of the boat is pivotally mounted at the base to the transverse beam of connection between the two hulls and is kept in position by an appropriate device, substantially a piston device, which is firmly mounted on the mast. This device has a movable end which is firmly mounted on the piston, is connected to the shrouds running from their remote ends at the top of the mast to the movable point of the device after winding around appropriate lateral tensioning pulleys and central positioning pulleys. This piston device substantially comprises a cylinder in which the piston is loaded by suitable resilient means such as helical springs and/or by an oleodynamic fluid so as to maintain the mast of the catamaran in an erect position up to a determined value of the force of the wind and permit the mast, when the wind exceeds this value, to bend relative to the boat and resume its erect position when the force of the wind decreases again below this value which thus constitutes a safety value determined by the calibration of the resilient means and/or the drive and control means of the oleodynamic circuit of the piston device.

Another basic feature of the present invention consists in that the catamaran is provided with at least two tensioning means for the shrouds, one of these tensioning means being provided on each side of the mast. Each of these tensioning means is substantially formed of a movable member projecting axially from a fixed member to which the movable member is connected and is mounted thereon by appropriate resilient means such as helical springs, the movable members terminating at their free ends with appropriate pulleys passing outwardly of the shrouds kept under tension and recovering the backlash thereof when, due to bending of the mast, one of them shortens and the other lengthens.

According to a preferred embodiment of the invention, the piston device substantially comprises an oleodynamic-mechanical device, i.e. the cylinder is filled with oleodynamic fluid and the piston is loaded by an appropriate helical spring extending axially within the cylinder and urging against the peripheral portion of the head of the piston, the piston head being in turn constituted by two concentric members movable axially relative to each other and kept tight by an appropriate resilient means such as a helical spring placed between the two movable parts, which are movable axially relative to each other and substantially formed by a crown-shaped part having a bossed central hub, and a solid piston part having an outside diameter corresponding to the inside diameter of the bossed hub, the bossed hub being provided with appropriate apertures communicating the inside of the cylinder with the outside portion of the oleodynamic circuit which is constituted by a tank and a pipe located outwardly of the cylinder and in turn provided with an oleodynamic pump and at least two unidirectional valves, one located downstream of the pump and the other on the pipe, these two valves permitting the circulation of the oil in the direction cylinder-pipe-cylinder in the system both when the apertures in the cylinder head are open (safety value exceeded), which causes shifting of the entire piston head toward the upper point (larger helical spring compressed), and when the apertures in the piston head are closed (safety value regained), but when the entire piston head is shifted from its usual rest position and is in the "upper" position (larger helical spring compressed) permits the helical spring to act on the piston head and causes it to return due to the unidirectional circulation of the oil in the system.

It is to be noted that, when the piston head is in the rest position (mast upright), the oil cannot circulate and the piston head will remain in position until the wind acting on the sail causes the helical central calibration spring to exceed the value of calibration assigned thereto, whereafter, when this value has been exceeded and the apertures in the cylinder head open, the oil can circulate and the piston head move upwardly to compress the helical external spring of larger diameter, which spring will act on the piston head and cause it to return to the rest position when the central helical calibration spring will have returned within the safety value and close the apertures for the passage of the oil in the piston head.

According to another embodiment of the invention, the piston device substantially comprises a mechanical device, i.e. a device constituted by a cylinder in the interior of which a piston is mounted for sliding movement and has a piston head biased axially and resiliently by a helical spring of a diameter slightly smaller than the inside diameter of the cylinder, the piston head thus being biased and calibrated exclusively by the spring.

It will be evident that according to this embodiment the mast of the boat will bend as soon as the load produced by the wind on the sail exceeds the load of calibration of the helical spring which will return the mast into position as soon as the load will descend below the value of calibration of the spring.

According to still another embodiment of the invention, the piston device substantially comprises an oleodynamic device, i.e. a device constituted by a cylinder filled with oleodynamic fluid. In the interior of the cylinder a piston is mounted for axially sliding movement and has a cylinder head biased only by the oledynamic pressure prevailing upstream, an appropriate pipe with an oleodynamic pump and a unidirectional valve being provided outwardly of the cylinder and being further provided with an appropriate calibration valve bypassing the pump and the associated valve, the calibration valve determining the load at which it opens to permit the circulation of the oleodynamic fluid and the upward movement of the piston head toward the upper portion of the cylinder. When the load is less than this calibration load, the valve closes again to stop the upward movement of the piston head which will instead be returned to the rest position due to the pump provided on the pipe located outwardly of the cylinder and acting on the oleodynamic fluid through the unidirectional valve provided downstream of the pump.

DESCRIPTION OF PREFERRED EMBODIMENT

Figure 1:
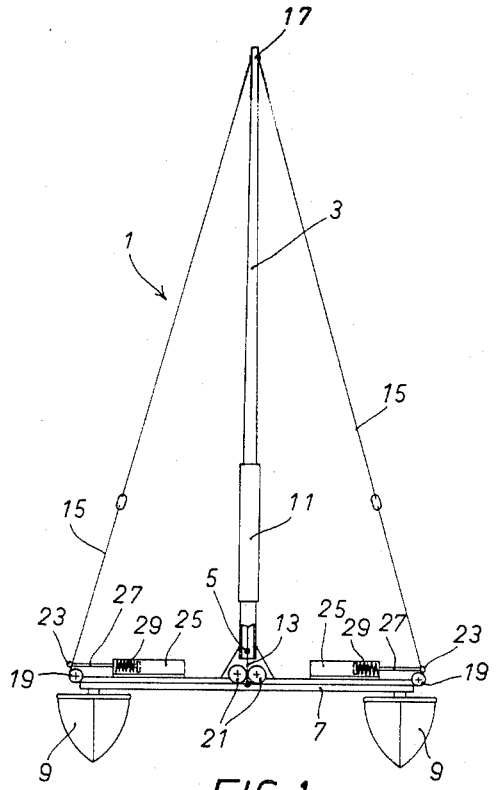
FIG. 1 is a front view of a catamaran to which a device according to the present invention has been applied, the mast being shown in the upright position.
Figure 2:
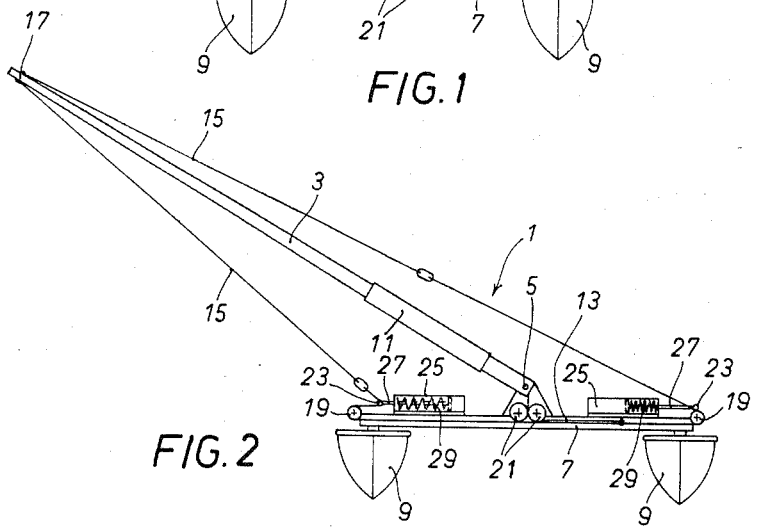
FIG. 2 is a front view of the catamaran of FIG. 1, showing the mast in a position in which it is inclined to one side.
Figure 3:
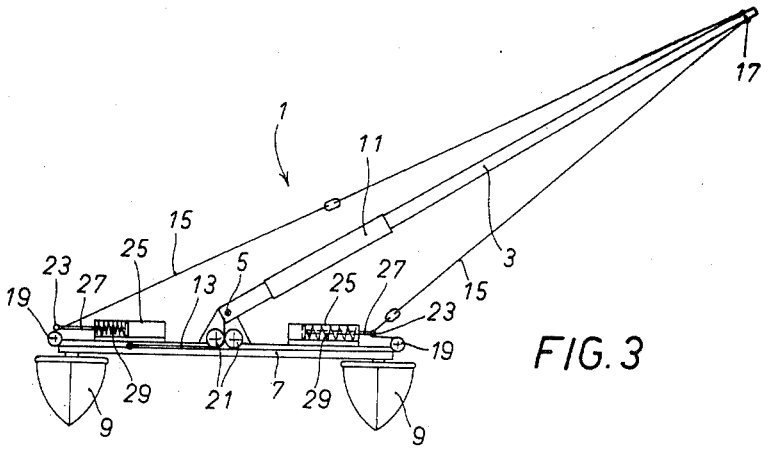
FIG. 3 is a view similar to FIG. 2, illustrating the catamaran with the mast inclined toward the opposite side.

As shown in FIG. 1, a catamaran 1 is provided with a mast 3 pivotally mounted at 5 on a transverse beam 7 which connects two hulls 9.

A piston device 11 for holding the mast in position is firmly connected to the mast 3. A rope 13 comes out of the device 11 and is connected in a continuous manner to shrouds 15.

More precisely, the shrouds 15, which at the remote end are secured at 17 to the top of the mast 3, are connected to the device 11 at 12 after passing around at least two tensioning pulleys 19 and two positioning pulleys 21 placed at the ends and in the center of the transverse beam 7, respectively.

The shrouds 15, before passing over the pulleys 19, pass below at least two other small pulleys 23 placed at the outer ends of two tensioning devices 25 each provided with a projecting tensioning rod 27 and resilient "pulling" means 29.

The tensioning devices 25 have the function of keeping the shrouds 15 under tension when the mast 3 inclines laterally, thus compensating the variation of the length thereof.

Figure 4:
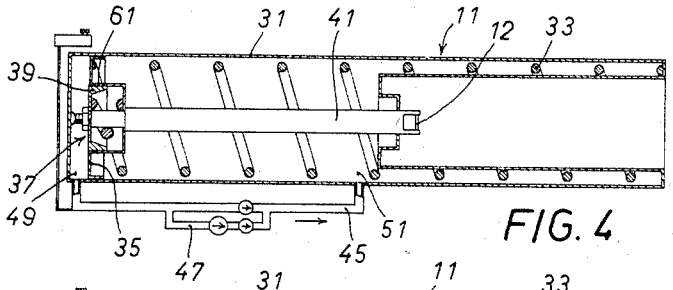
FIGS. 4, 5 and 6 are detailed sectional views illustrating the oleodynamic-mechanical piston device for controlling the mechanism for inclination and straightening of the mast in the rest position, the position of beginning of the path of inclination and the position of the end of inclination (maximum inclination), respectively.
Figure 5:
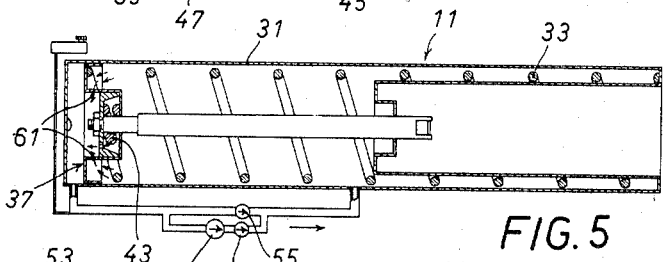
Figure 6:
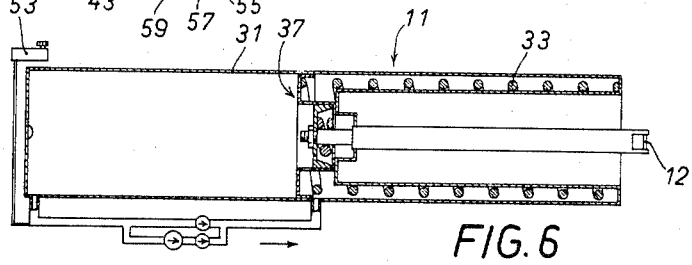

The piston device 11, in its preferred embodiment shown in FIGS. 4, 5 and 6, is substantially constituted by an oleodynamic cylinder 31 in the interior of which a helical spring 33 is arranged which has a diameter almost as large as the inside diameter of the cylinder 31 and is supported on a peripheral portion 35 of a piston head 37. The piston head 37 is constituted by two concentrical parts movable axially relative to each other, i.e. an outer part in the form of a circular crown 35 and an inner hub part 39 connected axially to a piston rod 41.

The outer crown-shaped part 35 has a bossed central hub into which snugly fits the inner hub part 39 having substantially the same diameter. The two parts forming the piston head 37 are biased by a helical tensioning spring 43, which is arranged between these two parts and causes them to be closed until a load greater than the load of calibration acts axially.

Provided outwardly of the cylinder 31 is a pipe 45 extending parallel to another pipe 47, the pipe 45 connecting a bottom 49 of the cylinder 31 to a head 51 of the cylinder 31 and to a reserve tank 53, i.e. a tank for feeding the oleodynamic fluid.

The pipes 45 and 47 are provided with unidirectional valves 55 and 57 and with a pump 59 placed upstream of one of the unidirectional valves.

Apertures 61 are provided on the bossed hub of the crown-shaped outer part 35 of the piston head 37 to open when the load acting on the sail carried by the mast 3 exceeds the force of calibration of the helical spring 43.

When this load is exceeded, the helical spring 43 is compressed and causes relative movement of the two parts forming the piston head 37 and opening, as mentioned before, of the apertures 61, which permits the entire piston head 37 to shift axially in the cylinder 31 toward the head 51 of the cylinder.

Under these conditions it is to be noted that the oleodynamic fluid will circulate from the cylinder 31 to the bottom 49 thereof, from there through the pipes 45 again into the cylinder 31, but traversing the apertures 61 in the circular crown 35 of the piston head 37.

When the piston head 37 has shifted toward the head 51 of the cylinder and the load decreases below the safety level, the helical spring 43 will return into position the two parts 35 and 39 forming the piston head 37 so that the apertures 61 are closed. The return movement of the piston head 37 is obtained due to the action of the helical spring 33 acting on the crown-shaped part 35 of the piston head 37 and due to the fact that this action is made possibile by the circulation of the oil through the pipe 45 and the unidirectional valves 55.

If it is desired to accelerate the return movement of the psiton head 37 or simply make it more marked, in case the helical spring 33 should not act with sufficient rapidity and force, return movement can be produced by starting the oleodynamic pump 59 which through the unidirectional valve 57 permits the circulation of the oil along the path cylinder-pipe-pump-cylinder.

FIG. 4 shows the oleodynamic-mechanical device described above in the rest position. In this position the mast is not subjected to thrust or only to thrust lower than the load of calibration of the helical spring 43.

FIG. 5 shows the device when the load on the mast has just exceeded the value of the load of calibration of the helical spring 43. In this position the two parts 35 and 39 forming the piston piston head 37 have shifted relative to each other and opened the apertures 61, which permits circulation of the oil in the cylinder through the piston head 37.

FIG. 6 shows the device in a position in which the piston head 37 has reached the head 51 of the cylinder, in this position the load exerted on the mast being even higher than the load of calibration.

It is evident that under these conditions the mast will reach its maximum inclination relative to the catamaran to which it is applied.

Figure 7:
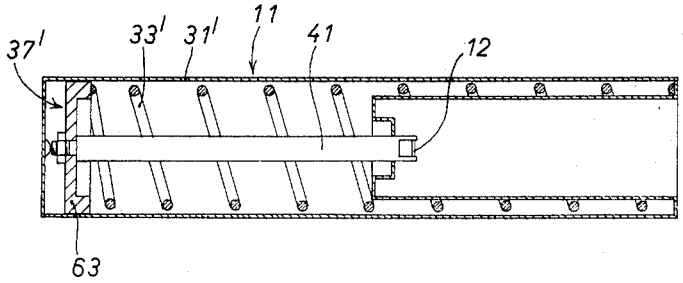
FIG. 7 is a detailed sectional view of another embodiment of the piston device and more precisely an embodiment with a helical spring.

FIG. 7 shows another embodiment of the present device, i.e. an embodiment with a substantially mechanical piston. In this embodiment, the device is substantially constituted by a cylinder 31′ analogous to the cylinder 31 described previously, in the interior of which a helical spring 33′ is provided which is completely similar to the helical spring 33 provided in the previous embodiment, but the piston 37′ is made in a single piece 63 which is biased by the helical spring 33′.

It is evident that in this embodiment the piston 37′ will move under the effect of the load exerted on the mast when this load exceeds the calibration of the helical spring 33′, i.e. the piston 37′ shifts in proportion of the load exerted on the mast and returns into position as soon as this load diminishes or ceases.

Figure 8:
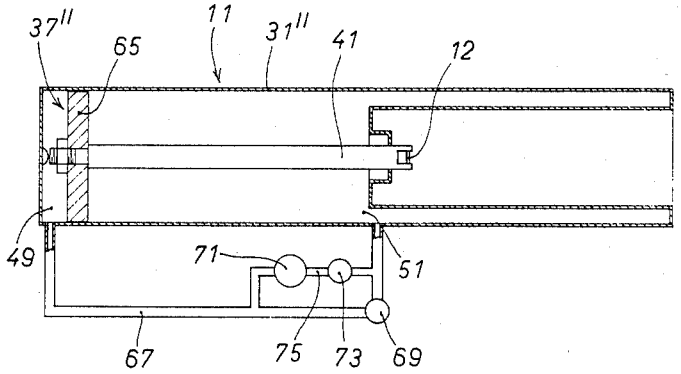
FIG. 8 is a detailed sectional view of another embodiment of the piston device and more precisely the only oleodynamic embodiment without resilient means.

Instead, FIG. 8 shows another embodiment of the present device which is exclusively oleodynamic and substantially constituted by a cylinder 31″, in the interior of which there is arranged a piston 37″ with a conventional piston head 65 and piston rod 41. Provided adjacent the cylinder 37″ is an oleodynamic pipe 67 analogous to the pipe 45 described previously with the only difference that a calibration valve 69 is provided in the pipe 67.

The operation of the device is as follows: when the pressure in the interior of the cylinder 31″ exceeds a certain value of calibration (again on the basis of the load exerted on the rod due to the thrust of the wind exerted on the mast), the valve 69 opens to permit the circulation of the oil in the direction to the top of the cylinder 51 - pipe 67 - bottom 49 of the cylinder, which permits the piston 37″ to shift upwardly. When the load has ceased or decreased below the level of calibration, the valve 69 will close and the piston can be returned to the rest position due to the action of the oleodynamic pump 71 and the unidirectional valve 73 which acts on the head 65 of the piston 37″ in the opposite direction: bottom of the cylinder 49 - pipe 67, 75 - valve 73 - top of the cylinder 51.

It is evident that the invention is not limited to the described and illustrated embodiments, but that numerous variations and further improvements obvious to one skilled in the art may be made therein without thereby departing from the scope of the invention as defined by the appended claims.

I claim:

1. A safety device used with a catamaran for avoiding capsizing of the catamaran, the catamaran having a mast pivotally mounted at its base on a transverse beam of connection of two hulls of the catamaran, comprising a hollow cylinder mounted on the mast having a first end portion and a second end portion, a piston rod slidably mounted in the cylinder having a first end portion and a second end portion, shrouds mounted on the second end portion of the piston rod and extending to the top of the mast, pulley means mounted on the catamaran for tensioning and positioning the shrouds, and means for biasing the piston rod toward the first end portion of the cylinder maintaining the mast of the catamaran in an erect position up to a predetermined value of force and for permitting the mast, when the force of the wind exceeds the predetermined value of force, to bend relative to the catamaran and to resume its erect position when the force of the wind decreases below the predetermined value, the predetermined value being determined by the piston rod biasing means.

2. A device for avoiding capsizing of catamarans as claimed in claim 1, the piston rod biasing means being helical springs.

3. A device for avoiding capsizing of catamarans as claimed in claim 1, the piston rod biasing means being an oleodynamic fluid contained in said cylinder.

4. A device for avoiding capsizing of catamarans as claimed in claim 1, further including an oleodynamic circuit mounted on the cylinder having drive and control means for determining the predetermined value of the piston rod biasing means.

5. A device for avoiding capsizing of catamarans, wherein a mast of the catamaran is pivotally mounted at its base on a transverse beam of connection of two hulls of the catamaran and kept in position by said device, said device substantially comprising a piston device firmly mounted on said mast and having a movable end firmly connected to a piston and to shrouds of the catamaran, said shrouds extending from a remote end at the top of said mast to said movable end of said device after winding around appropriate lateral tensioning pulleys and central positioning pulleys, said piston device substantially comprising a cylinder receiving said piston for axially sliding movement therein, said piston being biased by appropriate resilient means to maintain said mast of said catamaran in an erect position up to a predetermined value of the force of the wind and permit said mast, when the wind exceeds said value, to bend relative to the catamaran and resume its erect position when the wind decreases again below said value, said value being determined by the calibration of said resilient means, said catamaran being provided with at least two tensioning means for said shrouds, said tensioning means being provided one on each side of said mast and substantially comprising a movable member projecting axially from a fixed member connected thereto and mounted thereon by appropriate resilient means, said movable members terminating at their free ends with appropriate pulleys passing outwardly of said shrouds kept under tension, said movable members recovering the backlash of said shrouds when, due to bending of said mast, one of said shrouds when, due to bending of said mast, one of said shrouds shortens and the other lengthens.

6. A device for avoiding capsizing of catamarans as claimed in claim 5, said resilient means comprising helical springs.

7. A device for avoiding capsizing of catamarans, wherein a mast of the catamaran is pivotally mounted at its base on a transverse beam of connection of two hulls of the catamaran and kept in position by said device, said device substantially comprising a piston device firmly mounted on said mast and having a movable end firmly connected to a piston and to shrouds of the catamaran, said shrouds extending from a remote end at the top of said mast to said movable end of said device after winding around appropriate lateral tensioning pulleys and central positioning pulleys, said piston device substantially comprising a cylinder receiving said piston for axially sliding movement therein, said piston being biased by appropriate resilient means to maintain said mast of said catamaran in an erect position up to a predetermined value of the force of the wind and permit said mast, when the wind exceeds said value, to bend relative to the catamaran and resume its erect position when the wind decreases again below said value, said value being determined by the calibration of said resilient means, said piston device substantially comprising an oleodynamic mechanical device, said cylinder being filled with oleodynamic fluid and said piston being biased by said resilient means formed by a first helical spring extending axially within said cylinder and urging against a peripheral portion of a piston head of said piston, said piston head comprising a pair of concentric members movable axially relative to each other and kept tight by appropriate resilient means formed by a second calibrated helical spring placed between said pair of concentric members, said pair of concentric members being movable axially relative to each other and substantially comprising a crown-shaped part having a bossed central hub and a solid piston part having an outside diameter corresponding to the inside diameter of said bossed central hub, said bossed central hub being provided with apertures communicating the inside of said cylinder with the outside portion of said oleodynamic circuit, said oleodynamic circuit comprising a tank and a pipe located outwardly of said cylinder and provided with an oleodynamic pump and at least two unidirectional valves, one located downstream of said oleodynamic pump and the other on said pipe, said unidirectional valves permitting circulation of said oleodynamic fluid in the direction cylinder-pipe-cylinder in said oleodynamic circuit both when said apertures of said piston head are open to cause shifting of said piston head toward an upper position wherein said first helical spring is compressed, and when said apertures of said piston head are closed, but when said piston head is shifted from its usual rest position and is in said upper position with said first helical spring compressed permits said first helical spring to act on said piston head and causes the latter to return due to said unidirectional circulation of said oleodynamic fluid in said oleodynamic circuit.

8. A device for avoiding capsizing of catamarans, wherein a mast of the catamaran is pivotally mounted at its base on a transverse beam of connection of two hulls of the catamaran and kept in position by said device, said device substantially comprising a piston device firmly mounted on said mast and having a movable end firmly connected to a piston and to shrouds of the catamaran, said shrouds extending from a remote end at the top of said mast to said movable end of said device after winding around appropriate lateral tensioning pulleys and central positioning pulleys, said piston device substantially comprising a cylinder receiving said piston for axially sliding movement therein, said piston being biased by appropriate resilient means to maintain said mast of said catamaran in an erect position up to a predetermined value of the force of the wind and permit said mast, when the wind exceeds said value, to bend relative to the catamaran and resume its erect position when the wind decreases again below said value, said value being determined by the calibration of said resilient means, said piston device being a mechanical device comprising a cylinder and a piston mounted for sliding movement in said cylinder and having a piston head biased axially and resiliently by a helical spring of a diameter slightly smaller than the inside diameter of said cylinder, said piston head thus being biased and calibrated exclusively by said helical spring.

9. A device for avoiding capsizing of catamarans, wherein a mast of the catamaran is pivotally mounted at its base on a transverse beam of connection of two hulls of the catamaran and kept in position by said device, said device substantially comprising a piston device firmly mounted on said mast and having a movable end firmly connected to a piston and to shrouds of the catamaran, said shrouds extending from a remote end at the top of said mast to said movable end of said device after winding around appropriate lateral tensioning pulleys and central positioning pulleys, said piston device substantially comprising a cylinder receiving said piston for axialy sliding movement therein, said piston being biased by appropriate resilient means to maintain said mast of said catamaran in an erect position up to a predetermined value of the force of the wind and permit said mast, when the wind exceeds said value, to bend relative to the catamaran and resume its erect position when the wind decreases again below said value, said value being determined by the calibration of said resilient means, said piston device being an oleodynamic device comprising a cylinder filled with oleodynamic fluid and a piston mounted for axially sliding movement in said cylinder and having a piston head biased only by the oleodynamic pressure prevailing upstream, a pipe with an oleodynamic pump and a unidirectional valve being provided outwardly of said cylinder and being further provided with a calibration valve bypassing said oleodynamic pump and said unidirectional valve, said calibration valve determining the load at which it opens to permit circulation of said oleodynamic fluid and upward movement of said piston head toward an upper portion of said cylinder, when the load is less than said calibration load, said calibration valve closing again to stop the upward movement of said piston head and permit the latter to be returned to its rest position due to the action of said pump provided on said pipe located outwardly of said cylinder and acting on said oleodynamic fluid through said unidirectional valve provided downstream of said pump.

10. A device for avoiding capsizing of catamarans, comprising a mast pivotally mounted at the base on the transverse beam of connection of the two hulls and kept in position by appropriate means, consisting in a piston device, firmly mounted on the mast, whose movable end, firmly connected on the piston, is connected to the shrouds running from their remote ends at the top of said mast to said movable end of the piston device after winding around appropriate lateral tensioning pulleys and central positioning pulleys, wherein the tensioning means for said shrouds are at least two, and are provided one on each side of said mast and substantially comprise a movable member projecting axially from a fixed member connected thereto and mounted thereon by appropriate resilient means, said movable members terminating at their free ends with appropriate pulleys passing outwardly of said shrouds kept under tension, said movable members recovering the backlash of said shrouds when, due to bending of said mast, one of said shrouds shortens and the other lengthens.

11. A device for avoiding capsizing of catamarans as claimed in claim 10, wherein said resilient means comprises helical springs.

12. A device as claimed in claim 10, wherein said piston device substantially comprises an oleodynamic-mechanical device, wherein the cylinder is filled with oleodynamic fluid and the piston is biased by resilient means formed by a first helical spring extending axially within said cylinder and urging against a peripheral portion of a piston head of said piston, said piston head comprising a pair of concentric members movable axially relative to each other and kept tight by appropriate resilient means formed by a second calibrated helical spring placed between said pair of concentric members, said pair of concentric members being movable axially relative to each other and substantially comprising a crown-shaped part having a bossed central hub and a solid piston part having an outside diameter corresponding to the inside diameter of said bossed central hub, said bossed central hub being provided with apetures communicating the inside of said cylinder with the outside portion of said oleodynamic circuit, said oleodynamic circuit comprising a tank and a pipe located outwardly of said cylinder and provided with an oleodynamic pump and at least two unidirectional valves, one located downstream of said oleodynamic pump and the other on said pipe, said unidirectional valves permitting circulation of said oleodynamic fluid in the direction cylinder - pipe -cylinder in said oleodynamic circuit both when said apertures of said piston head are open to cause shifting of said piston head toward an upper position wherein said first helical spring is compressed, and when said apetures of said piston head are closed, but when said piston head is shifted from its usual rest position and is in said upper position with said first helical spring compressed permits said first helical spring to act on said piston head and causes the latter to return due to said unidirectional circulation of said oleodynamic fluid in said oleodynamic circuit.

13. A device as claimed in claim 10 wherein said piston device is a mechanical device comprising a cylinder and a piston mounted for sliding movement in said cylinder and having a piston head biased axially and resiliently by a helical spring of a diameter slightly smaller than the inside diameter of said cylinder, said piston head thus being biased and calibrated exclusively by said helical spring.

14. A device as claimed in claim 10, wherein said piston device is an oleodynamic device comprising a cylinder filled with oleodynamic fluid and a piston mounted for axially sliding movement in said cylinder and having a piston head biased only by the oleodynamic pressure prevailing upstream, a pipe with an oleodynamic pump and a unidirectional valve being provided outwardly of said cylinder and being further provided with a calibration valve bypassing said oleodynamic pump and said unidirectional valve, said calibration valve determining the load at which it opens to permit circulation of said oleodynamic fluid and upward movement of said piston head toward an upper portion of said cylinder, when the load is less than said calibration load, said calibration valve closing again to stop the upward movement of said piston head and permit the latter to be returned to its rest position due to the action of said pump provided on said pipe located outwardly of said cylinder and acting on said oleodynamic fluid through said unidirectional valve provided downstream of said pump.

* * * * *